United States Patent [19]

Peterson

[11] 4,185,817

[45] Jan. 29, 1980

[54] TEETH EXERCISER

[76] Inventor: Eugenia N. Peterson, 4080 S. Highland Dr., Salt Lake City, Utah 84117

[21] Appl. No.: 783,955

[22] Filed: Apr. 1, 1977

[51] Int. Cl.[2] ..... A63B 23/00

[52] U.S. Cl. ..... 272/95; 128/136

[58] Field of Search ..... 272/95; 128/62 A, 136

[56] References Cited

U.S. PATENT DOCUMENTS

| | | | |
|---|---|---|---|
| 1,466,559 | 8/1923 | Purdy | 272/95 |
| 1,586,499 | 5/1926 | Worth | 272/95 |
| 1,714,029 | 5/1929 | Kuhn | 272/95 |
| 1,851,865 | 3/1932 | Ptacek | 272/95 |
| 1,953,088 | 4/1934 | Purdy | 272/95 |
| 2,172,998 | 9/1939 | Grout et al. | 128/62 A |
| 2,192,558 | 3/1940 | Poindexter | 128/136 |
| 2,249,721 | 7/1941 | Morris | 128/62 A |
| 2,521,039 | 9/1950 | Carpenter | 128/136 |
| 2,643,652 | 6/1953 | Cathcart | 128/136 |
| 2,678,043 | 5/1954 | Stack | 128/136 |
| 2,827,899 | 3/1958 | Altieri | 128/136 |
| 2,966,908 | 1/1961 | Cathcart et al. | 128/136 |
| 3,096,761 | 7/1963 | Moffett | 128/136 |
| 3,187,746 | 6/1965 | Gerber | 128/62 A |
| 3,295,519 | 1/1967 | Gerber | 128/136 |
| 3,457,916 | 7/1969 | Wolicki | 128/136 |
| 3,525,520 | 8/1970 | Dwyer | 272/95 |
| 3,547,433 | 12/1970 | Robins | 272/95 |

FOREIGN PATENT DOCUMENTS

| | | | |
|---|---|---|---|
| 530998 | 10/1956 | Canada | 128/136 |
| 790252 | 7/1968 | Canada | 128/136 |
| 886254 | 11/1971 | Canada | 128/136 |
| Ad.67616 | 10/1956 | France | 128/136 |
| 151137 | 9/1920 | United Kingdom | 272/95 |

*Primary Examiner*—Richard J. Johnson

*Attorney, Agent, or Firm*—B. Deon Criddle

[57] ABSTRACT

A teeth exerciser adapted to be inserted in the mouth so that biting or chopping thereon will exercise the teeth. The teeth exerciser has a generally U-shaped configuration and is formed from a yieldable resilient material such that the bite surface or portion of the device will provide a generally uniform reaction pressure on all teeth being exercised. Upstanding positioning flanges extend from portions of the inner and outer edges of the bite surface.

4 Claims, 4 Drawing Figures

TEETH EXERCISER

BRIEF DESCRIPTION OF THE INVENTION

1. Field of the Invention

This invention relates to devices for use in exercising teeth.

2. Prior Art

Teeth, mouth, and gum exercisers are well known and are in common use. These known teeth and gum and mouth exercisers are widely varied in design and purpose. Some utilize springs and tension bars to bias various components, while others have handles or appendages for moving the device in the mouth and/or for tongue positioning or hingedly interconnected parts. Still others are adapted for use with limited numbers of teeth and not for simultaneous use with all teeth.

Typical teeth, gum and mouth exercisers of the type described, are shown for example in U.S. Pat. Nos. 1,586,499, 1,714,029, 1,851,865, 1,953,088, 2,172,998, 2,249,721, 3,187,746, 3,295,519, 3,547,433 and 3,525,520.

So far as I am aware there has not been developed a teeth exerciser having a U-shaped bite surface or portion contoured to fill the gap normally occurring between the upper and lower rows of teeth when the front teeth of each row are aligned so as to provide uniform upper and lower pressure during exercise of the teeth and with positioning flanges extending partially around both the inside and the outside of the U-shaped bite surface or portion to provide for proper positioning of the device without irritation of tender gum tissue and without obstructing teeth movement during exercising.

In general, the teeth exerciser of the present invention is somewhat similar, in appearance, to teeth and mouth protectors that are presently commercially available. U.S. Pat. No. 2,827,899 for example, discloses a known teeth and mouth protector formed as a generally U-shaped trough and having a flat bite surface or portion, continuous inner and outer flanges that are interconnected by end flanges and a moldable insert which is adapted to be impression fitted to the shape of the teeth and that comprises a portion of the trough of the main body member.

SUMMARY OF THE INVENTION

It is a principal object of the present invention to provide an inexpensive teeth exerciser that can be safely and easily inserted into the mouth such that simple biting or chopping motions will provide exercise and stimulation for the teeth and gums.

Other objects are to provide a teeth exerciser that can be readily formed from a hygenic, non-toxic, resilient and yieldable material such as silicone rubber, or the like, and that can be easily carried on the person of an individual for use when and as desired.

Still another object is to provide a teeth exerciser with a bite surface contoured to fill the natural gap occurring between the upper and lower teeth when the upper and lower front teeth are aligned, so that uniform pressure can be simultaneously applied on all of the teeth as they are exercised.

Principle features of the present invention include a generally U-shaped bite surface or portion sized to fit over the upper teeth in a persons mouth. The U-shaped bite surface is relatively narrow at its apex and has a gradually increasing cross section to become thicker at the ends of the legs of the bite surface. A flat underside of the bite surface rests on and provides a reaction surface for the lower teeth. A sloped upperside of the bite surface compensates for and fills the gap which normally exists between the upper and lower rows of teeth when the upper and lower front teeth are aligned and clamped, with the apex of the bite surface between them.

The U-shaped bite surface has inner and outer edges and upstanding flanges extend therefrom. The flanges extending from the outer edge extends essentially perpendicular to the underside of the bite surface and the flange extending from the inner edge has an inner wall that slopes outwardly away from the bite surface. The slope is more pronounced at the apex of the bite surface and is less prominent at the ends of the flange. The flanges extend most prominently from the bite surface around the curve of the bite surface and then slope to the upperside of the bite surface, with the inner flange terminating at about the midpoint of each leg and the outer flange terminating at about one-third the length of the leg from the apex. The flanges, as thus described, does not so encircle the teeth that undue pressure or friction is applied to the gums, thus avoiding gum irritation.

Additional objects and features of the invention will become apparent from the following detailed description, taken together with the accompanying drawing.

THE DRAWING

In the drawing:

FIG. 1 is a perspective view of the teeth exerciser of the present invention, taken from slightly above and at one corner of the device;

FIG. 2, a similar view taken from slightly above and at one end of the device;

FIG. 3, an elevation view taken from one end of the device; and

FIG. 4, a vertical section view taken along the line 4—4 of FIG. 2 and showing the slope of the upperside of the biting surface of the device.

DETAILED DESCRIPTION OF THE INVENTION

Figure 1:
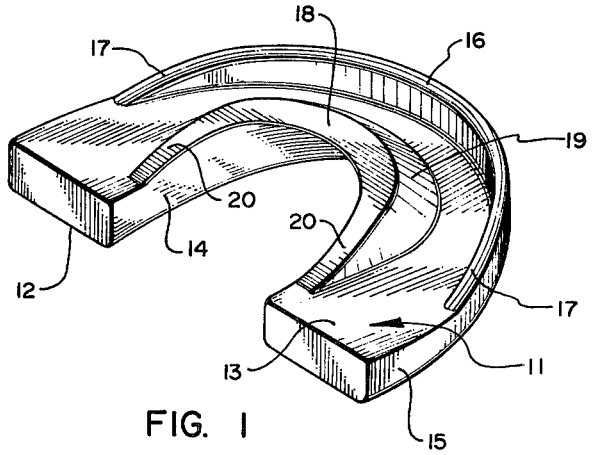
Figure 2:
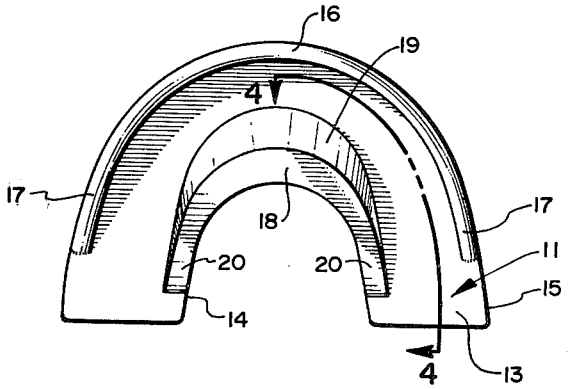
Figure 3:
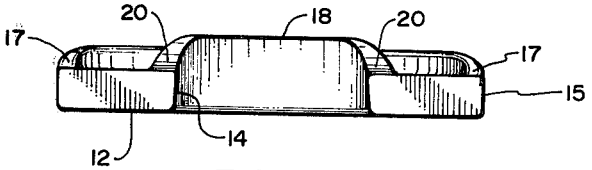

Referring now to the drawing:

In the illustrated preferred embodiment, the teeth exerciser 10 of the present invention includes a generally U-shaped bite surface or portion 11, having a flat underside 12 and a sloping upperside 13, to be further explained. The U-shaped bite surface has an inner edge 14 and an outer edge 15.

An outer flange 16 extends normal to the underside 12 and projects inwardly from a portion of the outer edge 15. The flange 16 extends for its full height around the curved portion of the U-shaped bite surface and the upper edge of the flange is then sloped down at 17 to the bite surface at a location on each leg thereof that is about one-third of the distance from the apex to the end of the leg.

An inner flange 18 extends upwardly from the inner edge 14 of the bite surface 11. The inner flange has an inner wall 19 that is sloped away from the bite surface and an upper edge curved to conform generally to the curve of the inner edge 14 of the bite surface and sloped at 20 to a location about midway of the legs of the bite surface. The sloped inner wall 19 of the inner flange slopes most prominently at the apex of the bite surface and less prominently at the junctions of the ends of the inner wall and the bite surface.

Figure 4:
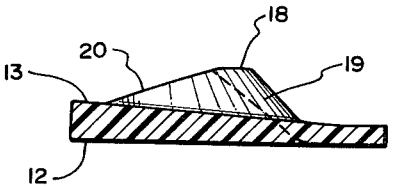

As shown best in FIG. 4, the bite surface has a gradually changing cross-sectional thickness. As shown, the bite surface has less thickness at the apex thereof and the thickness gradually increases as the upperside 13 slopes upwardly away from the apex with respect to the flat underside 12.

In use the teeth exerciser of the present invention is inserted into the mouth of the user with the apex of the bite surface being positioned at the front of the mouth and with the flanges 16 and 18 and the bite surface 11 encasing the front teeth in the upper row of teeth. The upper and lower teeth are thus separated by the bite surface and exercising may be commenced. Exercise of the teeth is accomplished by a biting or chopping motion being exerted by the user with the teeth exerciser in place. The material from which the teeth exerciser is made must be sufficiently pliant and resilient to allow for yielding but should be too strong for the user to bite through.

When the front teeth are aligned and clamped on the bite surface, a gap normally would exist between the upper side teeth in the lower rows of teeth. The gradual slope of the upper bite surface 16 provides a filler between those two rows of teeth and will allow for a simultaneous reaction pressure on all of the teeth of a user as the teeth are exercised.

Since the flanges 16 and 18 extend only partially around the bite surface they do not project up to engage soft tissues surrounding the side teeth in the mouth. Also, the sloping inner wall 19 of the flange 18 allows the teeth to be closed into the desired clamping relationship without damage to surrounding tissue.

Although a preferred form of my invention has been herein disclosed, it is to be understood that the present disclosure is made by way of example and that variations are possible without departing from the scope of the hereinafter claimed subject matter, which subject matter I regard as my invention.

I claim:

1. A teeth exerciser molded in a single piece from a durable, pliant material comprising a generally U-shaped bite portion having a flat underside, an upperside sloped upwardly from the apex of the bite portion to the ends of the legs thereof, whereby the bite portion has a constantly increasing thickness from the apex to the ends of the legs, an inner edge and an outer edge; and flanges projecting upwardly from the bite portion at the inner and outer edges thereof.

2. A teeth exerciser as in claim 1, wherein the flange projecting upwardly from the bite portion at the outer edge extends farthest from the bite portion at the curve thereof and has an upper edge tapered to the bite portion at each leg thereof at a location about one-third of the distance between the apex and the end of the leg.

3. A teeth exerciser as in claim 2, wherein the flange projecting upwardly from the bite portion at the inner edge includes an inner face sloped away from the bit portion and an upper edge curved to conform generally to the curve of the bite portion extending farthest from the bite portion around the curve thereof and tapered to intersect the legs of the bite portion at a location about one-half of the distance between the apex and the end of each leg.

4. A teeth exerciser as in claim 1, wherein the flange projecting upwardly from the bite portion at the inner edge includes an inner face sloped away from the bite portion and an upper edge curved to conform generally to the curve of the bite portion, extending farthest from the bite portion around the curve thereof and tapered to intersect the legs of the bite portion at a location about one-half of the distance between the apex and the end of each leg.

* * * * *